US006945325B2

(12) United States Patent
Ford et al.

(10) Patent No.: US 6,945,325 B2
(45) **Date of Patent: *Sep. 20, 2005**

(54) RUN AND RETRIEVAL WEAR BUSHING AND TOOL

(75) Inventors: David L. Ford, Katy, TX (US); William Mair, New Iberia, LA (US)

(73) Assignee: Vetco Gray Inc., Houston, TX (US)

( * ) Notice: Subject to any disclaimer, the term of this patent is extended or adjusted under 35 U.S.C. 154(b) by 177 days.

This patent is subject to a terminal disclaimer.

(21) Appl. No.: 10/449,405

(22) Filed: May 30, 2003

(65) Prior Publication Data

US 2003/0192704 A1 Oct. 16, 2003

Related U.S. Application Data

(63) Continuation-in-part of application No. 09/717,870, filed on Nov. 21, 2000, now Pat. No. 6,749,018.

(51) Int. Cl.[7] ..... E21B 23/00; E21B 23/01

(52) U.S. Cl. ..... 166/85.3; 166/208; 166/85.5

(58) Field of Search ..... 166/85.3, 208, 166/75.14, 240, 85.1, 206, 214

(56) References Cited

U.S. PATENT DOCUMENTS 4,545,434 A * 10/1985 Higgins ..... 166/217
5,025,864 A * 6/1991 Nobileau ..... 166/348
5,044,438 A * 9/1991 Young ..... 166/382
5,163,514 A * 11/1992 Jennings ..... 166/368
5,199,495 A * 4/1993 Brammer et al. ..... 166/339
5,360,063 A * 11/1994 Henderson, Jr. ..... 166/208

* cited by examiner

*Primary Examiner*—David Bagnell
*Assistant Examiner*—Daniel P Stephenson
(74) *Attorney, Agent, or Firm*—Bracewell & Giuliani LLP

(57) ABSTRACT

A wear bushing has a lower portion that is landed on a casing hanger in a wellhead housing. The wear bushing is mounted to the running tool, which is joined to a drill string. With running-in keys locked on the tool, the wear bushing is lowered down the well into the wellhead housing. The wear bushing is landed on the casing hanger and anti-rotation pins are pressed upward as they contact a seal assembly. The wear bushing is rotated until the anti-rotation pins align and fall into slots. With the anti-rotation pins in the slots, the running tool is released from the wear bushing by opposite rotation, and the running tool may then be run deeper into the well. The wear bushing is extracted using a retrieval tool. The retrieval tool is axially positioned relative to the wear bushing such that tool retrieval teeth engage a wear bushing retrieval ring so that the wear bushing can be extracted from the casing hanger.

23 Claims, 4 Drawing Sheets

RUN AND RETRIEVAL WEAR BUSHING AND TOOL

CROSS REFERENCE TO RELATED APPLICATIONS

This is a continuation-in-part of U.S. patent application Ser. No. 09/717,870 titled "Bit Run and Retrieval Wear Bushing Tool," filed on Nov. 21, 2000 now U.S. Pat. No. 6,749,018.

BACKGROUND OF THE INVENTION

1. Field of the Invention

The present invention relates in general to an improved wear bushing, and in particular to an improved bit run and retrieval wear bushing and tool.

2. Brief Description of Related Art

A wear bushing is used in drilling applications to protect the inner profiles of the various components in the wellhead. In the prior art, wear bushings typically have been run or lowered down to the wellhead on a separate trip. One type of bit run wear bushing is held to a tool via shear pins. This bit run wear bushing has an internal ledge with a reduced inner diameter for retrieval. However, the tools used to run and retrieve the wear bushings occasionally release the wear bushings prematurely, and do not have full opening through the wear bushing. Thus, an improved bit run wear bushing would be desirable. Also, being able to selectively run the wear bushing, continue lowering the drill string and subsequently pull the drill string without retrieving the wear bushing would be useful.

SUMMARY OF THE INVENTION

A wear bushing has a lower portion that is landed on a casing hanger in a wellhead housing. The lower portion of the wear bushing has a shear ring that engages a locking profile in the casing hanger to lock the wear bushing to the casing hanger. A retrieval ring resides in a bore of the wear bushing and has passages for fluid flow. In the first embodiment, the inner surface of the retrieval ring has teeth for engaging retrieval teeth of a running tool when the tool is moved upward relative to the wear bushing. The retrieval ring is designed so that the only profile moving up or down in the drill string that will engage the ring is the retrieval teeth on the tool. A plurality of running-in keys extend radially inward through the bore of the wear bushing beneath the retrieval ring. A beveled or running-in ridge on the tool of the first embodiment mates with the running-in keys. The running-in ridges are spaced apart by vertical channels.

The wear bushing is mounted to the tool which is joined to a drill string. With the running-in keys locked on the tool, the wear bushing is lowered down the well into the wellhead housing. The wear bushing is landed on the casing hanger and downward extending anti-rotation pins are pressed upward as they contact a casing hanger seal assembly. The wear bushing is rotated until the anti-rotation pins align and fall into slots. With the anti-rotation pins in the slots, the wear bushing cannot be rotated relative to the casing hanger. The tool is released from the wear bushing by more rotation to disengage the support ridges from the keys. The weight of the drill string expands the split retrieval ring and releases the tool, allowing the drill string to then be run deeper into the well.

When pulling the drill string from the well with the first embodiment, the retrieval teeth of the tool snap into engagement with the retrieval ring of the wear bushing. Continued upward pull shears the shear ring and retrieves the wear bushing.

A second embodiment utilizes only running-in ridges and not retrieval teeth, thus it is only a running-in tool. The wear bushing is secured to the running-in tool by rotating the running-in tool and wear bushing relative to each other as necessary to align the running-in ridge with the running-in keys, and axially moving the first tool and wear bushing relative to each other. The running-in tool is such that the first tool lands the wear bushing on the casing hanger in the same manner as the first embodiment. The wear bushing is then released from the running-in tool by rotating the tool relative to the wear bushing to disengage the running-in ridge from the running-in keys. The operator lowers the drill string further to continue operations. On retrieval of the drill string, the wear bushing retrieval ring is not engaged by the running-in ridges, thus the wear bushing remains on the casing hanger.

When it is desired to retrieve the wear bushing, the operator could install the tool of the first embodiment. Alternatively, the operator could utilize a retrieval tool that has retrieval teeth but lacks running-in ridges.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
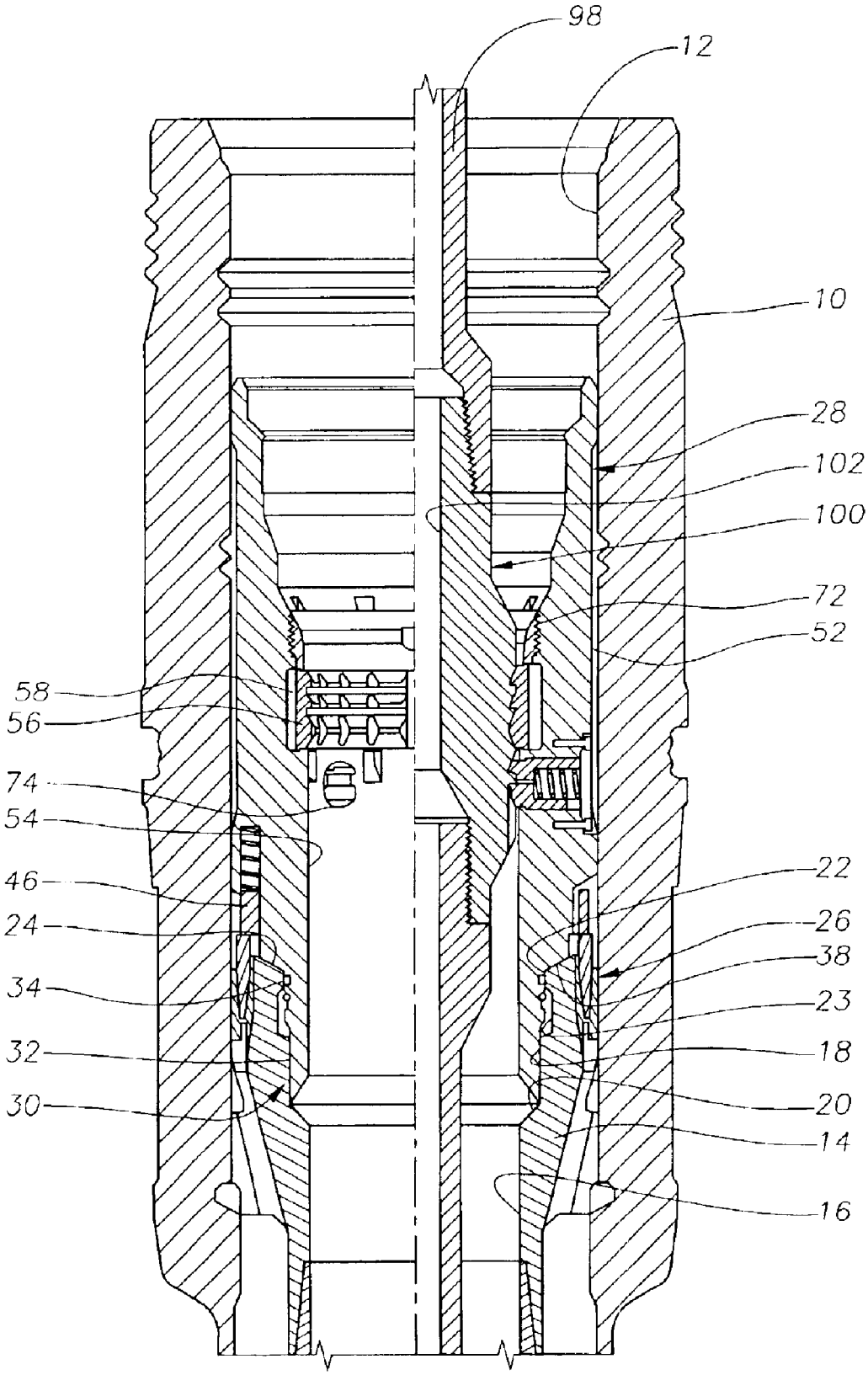
FIG. 1 is a sectional side view of a wear bushing constructed in accordance with the present invention and landed in a wellhead, with the right side showing a running tool engaged in the wear bushing.

Referring to FIG. 1, a subsea wellhead has a tubular outer wellhead housing 10 with an inner bore 12. Inner bore 12 concentrically accepts a casing hanger 14 that lands in housing 10. Casing hanger 14 has a bore extending through it, with a lower section 16 separated from a middle section 18 by a conical shoulder 20. The middle section 18 has a larger diameter than lower section 16. An upper section 22 of larger diameter than middle section 18 is located above middle section 18. There is a recess 23 with a diameter greater than upper section 22 between upper and middle sections 22, 18. The upper end of casing hanger 14 has a conical rim 24 that slopes downward and inward. A conventional seal assembly 26 seals the annular space between casing hanger 14 and inner bore 12.

Figure 2:
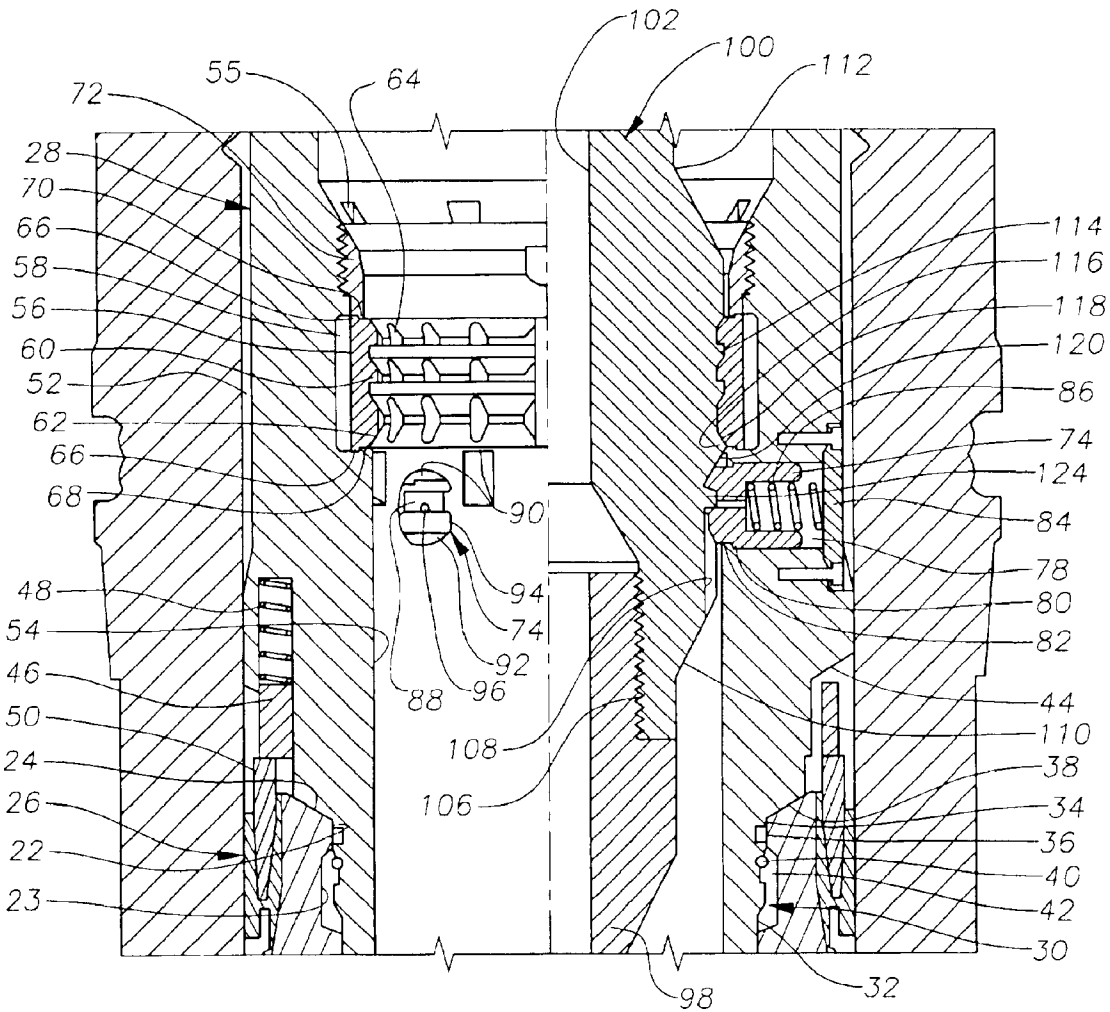
FIG. 2 is an enlarged sectional view of the wear bushing and running tool of FIG. 1 .

A wear bushing 28 constructed in accordance with the present invention lands in casing hanger 14. Wear bushing 28 is a generally tubular member and has a landing portion 30 on its lower end. Landing portion 30 has a lower portion 32 adapted to be tightly accepted in middle section 18. As shown in FIG. 2, landing portion 30 has an upper portion 34 adapted to be tightly accepted in upper section 22 and carries a seal 36 which seals against upper bore 22. A landing shoulder 38 is positioned above upper portion 34 such that when landing shoulder 38 rests on rim 24, lower portion 32 is concentrically accepted into middle section 18 of casing hanger 14 and upper portion is concentrically accepted into upper section 22.

Again referring to FIG. 2, the upper portion 34 has a shear ring 40 in a locking profile 42 that locks wear bushing 28 to casing hanger 14. Profile 42 is known in the art and adapted to allow landing portion 30 to stab into casing hanger 14 without shearing shear ring 40. Shear ring 40 then resides in recess 23 and must be sheared to pull wear bushing 28 apart from casing hanger 14.

A downward facing ledge 44 located above landing shoulder 38 retractably houses at least one anti-rotation pin 46. Anti-rotation pin 46 is urged downward by spring 48 and is adapted to engage slot 50 in the upper end of seal assembly 26. With anti-rotation pin 46 engaged in seal assembly 26, wear bushing 28 cannot be rotated relative to the casing hanger 14.

Wear bushing 28 extends upward from ledge 44 with an outer diameter that is slightly smaller than the diameter of bore 12. A central recessed portion 52 of wear bushing 28 has an outer diameter that is smaller than that of bore 12. An inner bore 54 of wear bushing 28 has a diameter that is substantially equal to the diameter of lower bore 16 in casing hanger 14. As shown in FIG. 1, the lower edge of inner bore 54 is chamfered.

A split retrieval ring 56 resides in an annular recess 58 in inner bore 54. A plurality of communication passages 55 are cut in bore 54 across recess 58, allowing flow of fluids around retrieval ring 56. The outer diameter of retrieval ring 56 is smaller than the inner diameter of recess 58, thereby enabling retrieval ring 56 to expand radially outward. The inner surface of retrieval ring 56 has biased teeth 60 which are shaped similar to the teeth of a saw blade. Each tooth 60 slopes inward and downward, then abruptly back outward. The lower end of retrieval ring 56 has a bevel 62 that extends from the inner diameter of ring 56 to substantially the same diameter as inner bore 54. The inner surface of retrieval ring 56 has notches 64 to provide a desired flexibility in retrieval ring 56, and to provide openings for debris to pass therethrough. Retrieval ring 56 has outer lips 66 extending from its lower and upper ends. Lips 66 are retained by a corresponding lip 68 on the lower end of recess 58, and a lip 70 on the lower end of a retaining ring 72, respectively. Retaining ring 72 threads into inner bore 54 above recess 58 after retrieval ring 56 is installed and slopes downward and inward. Retrieval ring 56 is biased inward so that teeth 60 protrude into bore 54.

A plurality of running-in keys 74 extend radially inward through inner bore 54 beneath retrieval ring 56. Running-in keys 74 retractably reside in stepped holes 78 and are spaced circumferentially apart from each other. Ridge 80 on key 74 engages a lip 82 in stepped hole 78 and limits inward radial movement of key 74. Stepped hole 78 is capped by plate 84, and a spring 86 is trapped between plate 84 and key 74, urging key 74 radially inward. The portion of running-in key 74 which protrudes into bore 54 has a horizontal slot 88. Each running-in key 74 has the following bevels or chamfers protruding into bore 54: upper 90, lower 92, and sides 94. A small hole 96 in running-in key 74 allows bore 54 to communicate with stepped hole 78.

Figure 3:
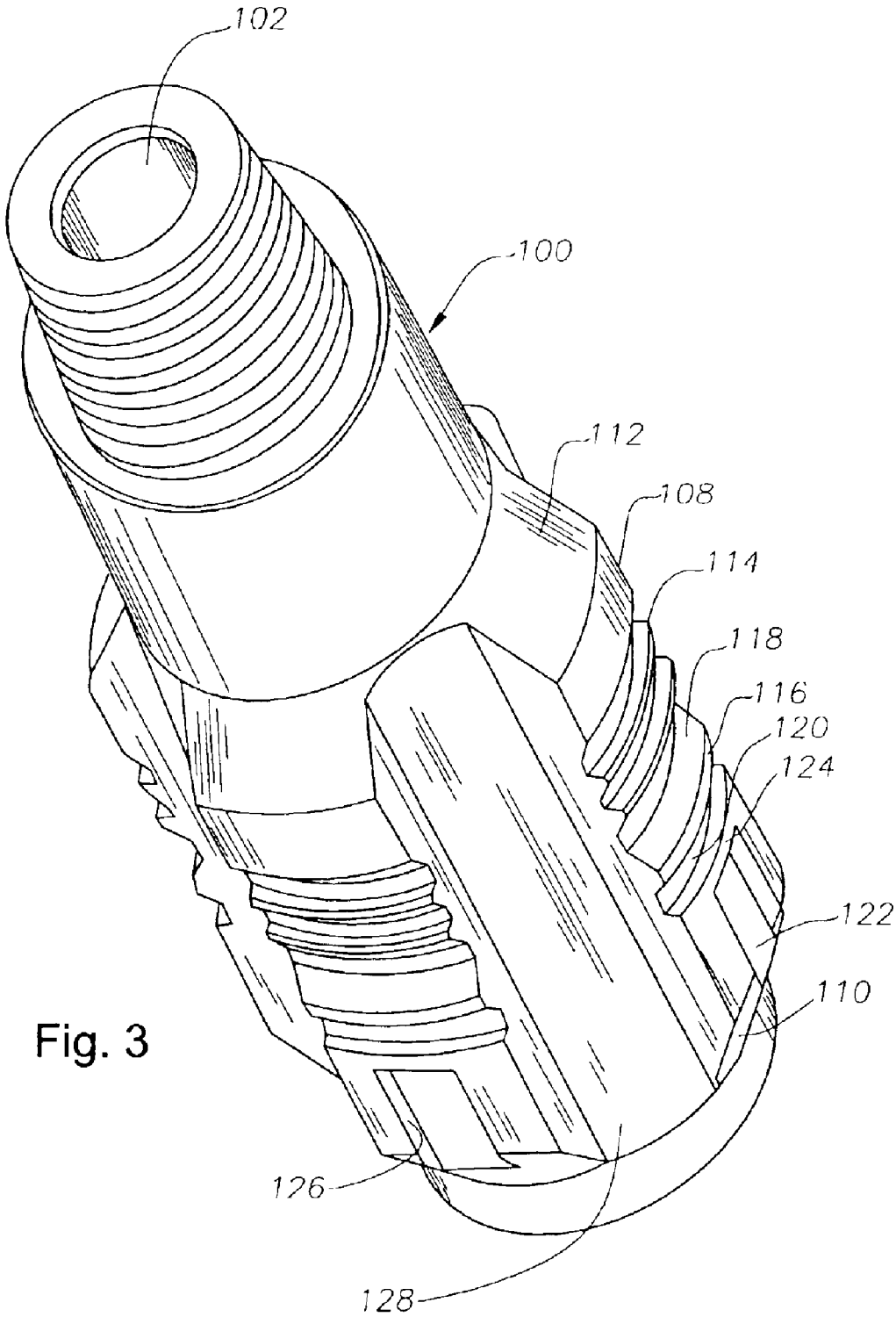
FIG. 3 is a perspective view of the running tool shown in FIG. 1.

Running and retrieval tool 100 is generally tubular and has a bore 102. The upper end and lower ends have threads that thread onto drill pipe 98. Referring to FIG. 2, tool 100 has a plurality of axial engaging blades 108 (four are shown). Blades 108 have a tapered lower edge 110 and a tapered upper edge 112. Beneath upper edge 112 reside a plurality of tool retrieval teeth 114 that are configured to mate with retrieval teeth 60 of wear bushing 28. Tool retrieval teeth 114 are adapted to engage and lift wear bushing retrieval teeth 60 when tool 100 is moved upward relative to wear bushing 28, and ratchet over wear bushing teeth 60 by flexing retrieval ring 56 outward when tool 100 is moved downward relative to wear bushing 28. A beveled ridge 116 (FIGS. 2 and 3) beneath teeth 114 has an upper bevel 118 that is adapted to mate with retrieval ring bevel 62. Beveled ridge 116 has a lower bevel 120 that is adapted to mate with the chamfer on running-in key upper edge 90. A plurality of slots 122 (FIG. 3) located above lower edge 110 form support ridges 124. Each slot 122 is sized to accept one running-in key 74, and the side edges of each recess 122 have bevels 126 for mating with running-in key side chamfers 94. Support ridge 124 is sized to fit in running-in key horizontal slot 88 (FIG. 2). Axially extending channels or flow passageways 128 (FIG. 3) separate each engaging blade 108. The four flow passageways 128 are rotationally offset by 45 degrees from the outer profiles or blades 108 to allow axial movement of tool 100 relative to wear bushing 28 in both axial directions.

In use, tool 100 is threaded into a drill string above the drill bit (not shown). Wear bushing 28 is placed on the rig floor and the drill string is run through bore 54 until tool 100 reaches wear bushing 28. Tool 100 is then rotated to align slots 122 with running-in keys 74, and tool 100 is run into wear bushing 28. As tool 100 is inserted into wear bushing 28, slanted lower edges 110 force retrieval ring 56 to flex radially outward around tool 100. As tool 100 proceeds further into wear bushing 28, lower edge 110 contacts running-in keys 74 and forces them radially outward around tool 100, and running-in keys 74 spring into slots 122. Slight rotation of tool 100 relative to wear bushing 28 may be necessary. Bevel 120 on tool 100 forces retrieval ring 56 outward until retrieval ring teeth 60 seat in tool retrieval teeth 114. At the same time, upper chamfer 90 of running-in key 74 contacts support ridge 124 and forces key 74 radially outward, allowing key 74 to slide over ridge 124 and horizontal slot 88 to accept ridge 124. When horizontal slot 88 accepts ridge 124, running-in keys 74 are locked on tool 100, and axial movement of tool 100 relative to wear bushing 28 is restrained. This also provides a positive indication that tool retrieval teeth 114 are seated in retrieval ring teeth 60.

With running-in keys 74 locked on tool 100, wear bushing 28 is carried on tool 100 and lowered down the riser into wellhead housing 10. Wear bushing 28 is landed on casing hanger 14 and anti-rotation pin 46 is pressed upward as it contacts seal assembly 26. Wear bushing 28 is rotated clockwise when viewed from above until anti-rotation pin 46 aligns and springs into slot 50. With anti-rotation pin 46 in slot 50, wear bushing 28 cannot be rotated relative to casing hanger 14. Tool 100 is then rotated 45 degrees (this embodiment can be released in either direction) to release tool 100 from wear bushing 28. Rotating tool 100 causes chamfers 94 of running-in keys 74 to slide over bevels 126 of slots 122 and forces running-in keys 74 out of engagement with support ridges 124. Keys 74 now locate within flow channels 128. Tool 100 may then be run deeper into the well as retrieval ring 56 will ratchet over tool retrieval teeth 114. Any equipment attached to the drill string will pass smoothly through wear bushing 28 and will not hang up on retrieval ring 56 because it will be deflected by bevel 62, teeth 60, and retaining ring 72. Drilling will continue with tool 100 in the drill string above the drill bit.

When the drill string is pulled back to the surface, wear bushing running and retrieval tool 100 is pulled upward into wear bushing 28. As tool 100 is pulled upward into bore 54 in wear bushing 28, sloped upper edge 112 contacts bevel 62 and forces retrieval ring 56 radially outward around tool 100 until retrieval ring teeth 60 can seat in tool retrieval teeth 114. When retrieval ring teeth 60 engage tool retrieval teeth 114, wear bushing 28 is lifted with tool 100. Wear bushing 28 is lifted to the surface with the drill string, then separated from tool 100 by pushing tool 100 downward through wear bushing 28. There is no need for running-in keys 74 to snap into engagement with slots 122, thus there is no need to rotate the string upon retrieval.

Figure 4:
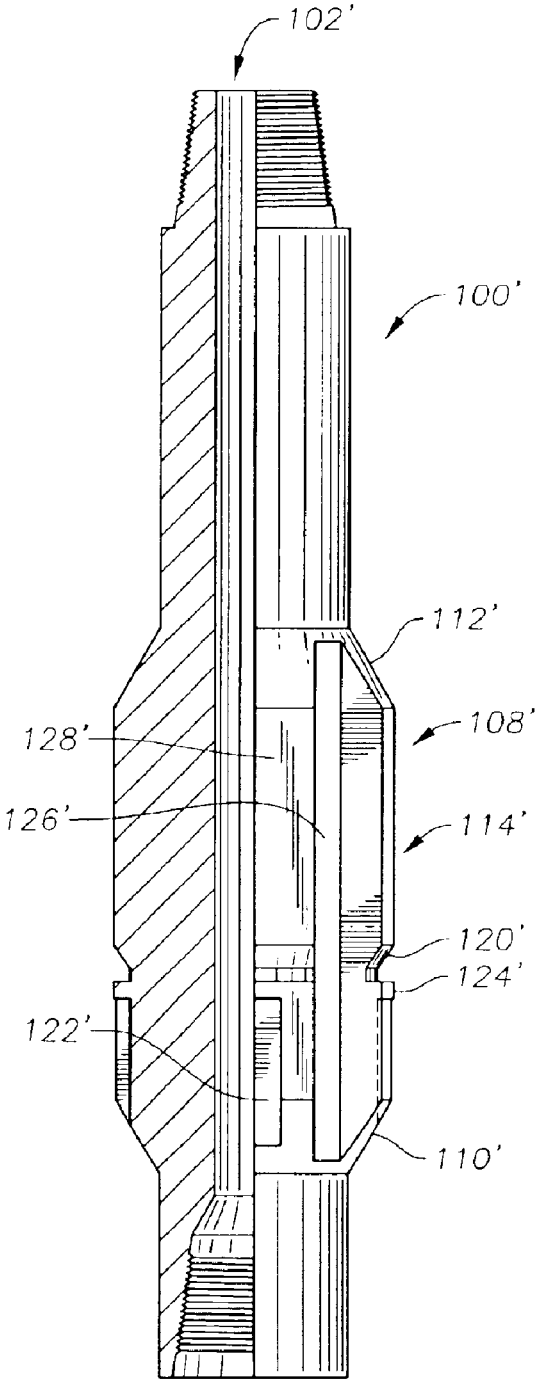
FIG. 4 is a sectional side view of a running tool according to another embodiment of the present invention used to deploy the wear bushing of FIG. 1.

Referring primarily to FIG. 4, in this embodiment, running tool 100' does not retrieve wear bushing 28 (FIG. 1), rather it runs it and allows the drill string to be lowered to drill ahead. Running tool 100' is generally tubular and has a bore 102'. The upper end and lower ends have threads that thread onto drill pipe 98. Tool 100' has a plurality of axial engaging blades 108' (four are shown for illustrative purposes in FIG. 3). Blades 108' have a tapered lower edge 110' on their lower end and a tapered upper edge 112' on their upper edge. Beneath upper edge 112' resides a generally cylindrically contoured transition surface 114' on each blade 108' employed to bypass wear bushing teeth 60 (FIG. 2) when tool 100' is moved upward or downward relative to wear bushing 28. The smooth transition past wear bushing teeth 60 is preferably accomplished by flexing retrieval ring 56 outward when tool 100' is moved relative to wear bushing 28.

The running-in configuration of tool 100' is the same as in the first embodiment. A bevel 120' that is adapted to mate with the chamfer on running-in key upper edge 90. Slot 122' located above lower edge 110' forms a support ridge 124'. Slot 122' is sized to accept running-in key 74. Support ridge 124' is sized to fit in running-in key horizontal slot 88 (FIG. 2). Flow channels 128' separate each engaging blade 108'. The four flow passageways 128' are preferably rotationally offset by 45 degrees from blades 108' to allow axial movement of tool 100' relative to wear bushing 28 in both axial directions.

In use, tool 100' is threaded into a drill string above the drill bit (not shown). Wear bushing 28 is placed on the rig floor and the drill string is run through bore 54 until tool 100' reaches wear bushing 28. Tool 100' is then rotated to align slots 122' with running-in keys 74, and tool 100' is run into wear bushing 28. As tool 100' is inserted into wear bushing 28, slanted lower edges 110' force retrieval ring 56 to flex radially outward around tool 100'. As tool 100' proceeds further into wear bushing 28, lower edge 110' contacts running-in keys 74 and forces them radially outward around tool 100' until keys 74 snap into slots 122'. Bevel 120' on tool 100' forces retrieval ring 56 outward. At the same time, upper chamfer 90 of running-in key 74 contacts support ridge 124' and forces key 74 radially outward, allowing key 74 to slide over ridge 124' and horizontal slot 88 to accept ridge 124'. When horizontal slot 88 accepts ridge 124', running-in keys 74 are locked on tool 100', and axial movement of tool 100' relative to wear bushing 28 is restrained.

The running-in operation is the same as in the first embodiment. With running-in keys 74 locked on tool 100', wear bushing 28 is carried on tool 100' and lowered down the riser into wellhead housing 10. Wear bushing 28 is landed on casing hanger 14 and anti-rotation pin 46 (FIG. 2) is pressed upward as it contacts seal assembly 26. Wear bushing 28 is rotated clockwise when viewed from above until anti-rotation pin 46 aligns and snaps into slot 50. With anti-rotation pin 46 in slot 50, wear bushing 28 cannot be rotated relative to casing hanger 14. Tool 100' is then rotated 45 degrees (this embodiment also can be released in either direction) to release tool 100' from wear bushing 28. Rotating tool 100' forces running-in keys 74 out of engagement with support ridges 124'. Tool 100' may then be run deeper into the well. Any equipment attached to the drill string will pass smoothly through wear bushing 28 and will not hang up on retrieval ring 56 because it will be deflected by bevel 62, teeth 60, and retaining ring 72. Drilling will continue with tool 100' in the drill string.

When the drill string is pulled back to the surface, wear bushing running tool 100' is pulled upward into wear bushing 28. As tool 100' is pulled upward into bore 54 in wear bushing 28, sloped upper edge 112' contacts bevel 62 (FIG. 2) and forces retrieval ring 56 radially outward around tool 100'. Transition surface 114' maintains retrieval ring 56 radially outward. Support ridges 124' do not match retrieval ring 56 as they are located only at the upper ends of slots 122'. Thus, wear bushing 28 is not affected by the upward transition of running tool 100'.

It is highly unlikely that slots 122' would be rotationally aligned with keys 74 when tool 100' passes upward through wear bushing 28. In the event that it did occur, keys 74 would snap into engagement with ridges 124'. The operator would notice the overpull occurring, however, and prior to pulling enough to shear out shear ring 40, he would rotate the string 45 degrees to disengage keys 74 from slots 122'.

If the operator wishes to retrieve wear bushing 28 on the next run, he could install the combination running and retrieving tool 100 of the first embodiment. It would pass through wear bushing 28 on the trip in because ring 56 ratchets over tool retrieval teeth 114 during the downward movement. It is highly unlikely that slots 122 would align with keys 74 on the trip in. If they did, the operator would notice the weight decrease, then rotate the string 45 degrees to disengage them.

Figure 5:
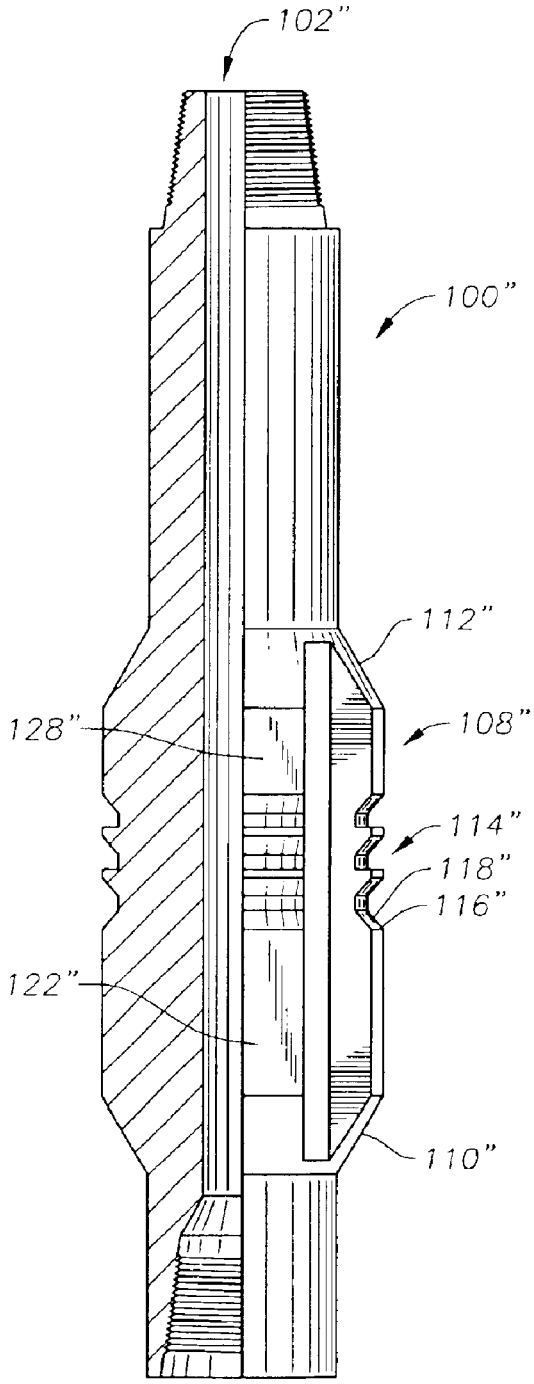
FIG. 5 is a sectional side view of a retrieval tool according to another embodiment of the present invention used to retrieve the wear bushing of FIG. 1.

If the operator does not have combination running and retrieval tool 100, he could utilize a retrieval tool 100" shown in FIG. 5. Retrieval tool 100" does not have running-in slots 122 (FIG. 2), but does have tool retrieval teeth 114" as in the first embodiment.

Retrieval tool 100" is generally tubular and has a bore 102". The upper end and lower ends have threads that thread onto drill pipe 98. Tool 100" has a plurality of axial engaging blades 108" (four are shown). Blades 108" have a tapered lower edge 110" on their lower end and a tapered upper edge 112" on their upper edge. Beneath upper edge 112" reside a plurality of tool retrieval teeth 114" that mate with teeth 60 (FIG. 2). Tool retrieval teeth 114" are adapted to engage wear bushing teeth 60 when tool 100" is moved upward relative to wear bushing 28, and ratchet over wear bushing teeth 60 by flexing retrieval ring 56 outward when tool 100" is moved downward relative to wear bushing 28. A beveled ridge 116" beneath tool retrieval teeth 114" has an upper bevel 118" that is adapted to mate with retrieval ring bevel 62. Above lower edge 110" resides a generally cylindrically contoured transition surface 122" employed to bypass running-in key 74 (FIG. 2) when tool 100" is moved downward or upward relative to wear bushing 28. Smooth transition past wear bushing teeth 60 (FIG. 2) is preferably accomplished by flexing retrieval ring 56 outward when tool 100" is moved downward relative to wear bushing 28. In the preferred embodiment, the tool includes flow passageways or channels 128", which separate each engaging blade 108". The four flow passageways 128" are rotationally offset by 45 degrees from blades 108" to allow better axial movement of tool 100" relative to wear bushing 28 in both axial directions.

In use, tool 100" is threaded into a drill string after wear bushing 28 (FIG. 2) has already been installed in casing hanger 14. As tool 100" passes downward through wear bushing 28, slanted lower edges 110" force retrieval ring 56 to flex radially outward around tool 100". As tool 100" proceeds further into wear bushing 28, lower edge 110" may contact running-in keys 74 and force them radially outward around tool 100" or channels 128" may align with keys 74. Ring 56 ratchets on tool retrieval teeth 114" as tool 100" continues downward. Drilling will continue with tool 100" in the drill string.

When the drill string is pulled back to the surface, wear bushing retrieval tool 100" is pulled upward into wear bushing 28 (FIG. 2). As tool 100" is pulled upward into bore 54 in wear bushing 28, sloped upper edge 112" contacts bevel 62 and forces retrieval ring 56 radially outward around tool 100" until retrieval ring teeth 60 can seat in tool retrieval teeth 114". When retrieval ring teeth 60 engage tool retrieval teeth 114", wear bushing 28 is lifted with tool 100". Shear ring 40, residing in recess 23, will be sheared during the extraction process to pull wear bushing 28 apart from casing hanger 14. Wear bushing 28, with retrieval ring teeth 60 of retrieval ring 56 engaging tool retrieval teeth 114", is lifted to the surface with the drill string, then separated from tool 100" by pushing tool 100" downward through wear bushing 28.

The present invention has several advantages. The wear bushing is designed to be run and retrieved with a tool or tools that are placed in the bottom hole assembly. It gives positive feedback to the rig floor when it gets into position or landed, and in an embodiment, it provides positive feedback when the wear bushing is released. The size of the tool does not interfere with the normal operation of the stabilizers. The wear bushing also incorporates a latch ring that is designed to allow for easy passage of any profile except that of the retrieval tool.

While the invention has been shown or described in only some of its forms, it should be apparent to those skilled in the art that it is not so limited, but is susceptible to various changes without departing from the scope of the invention.

What is claimed is:

1. A downhole assembly for a well, comprising in combination:

a wellhead housing having an axial bore with an upward facing shoulder;

a wear bushing including a tubular member having an axial bore with an internal recess;

a plurality of radially movable running-in keys mounted in the wear bushing, the running-in keys being movably biased to protrude into the axial bore;

a tool having threaded upper and lower ends for securing into a drill string;

a plurality of support ridges on the tool, the support ridges being spaced circumferentially apart from each other; wherein the wear bushing is secured to the tool by rotating the tool and wear bushing relative to each other as necessary to align the support ridges with the keys, enabling the tool to support the wear bushing until the wear bushing lands on the shoulder, and wherein the wear bushing is released from the tool by rotating the tool relative to the wear bushing to disengage the support ridges from the keys, enabling the drill string to be lowered further into the well.

2. The downhole assembly of claim 1, wherein the tool further comprises a plurality of axially extending channels located between the support ridges.

3. The downhole assembly of claim 1, wherein:

the tool has a set of retrieval teeth; and the wear bushing includes a set of retrieval teeth for engaging the retrieval teeth of the tool to retrieve the wear bushing.

4. The downhole assembly of claim 1, wherein the tool includes retrieval teeth for engaging retrieval teeth of a retrieval ring of the wear bushing, whereby the retrieval teeth of the tool will ratchet over the retrieval ring when the tool is moved downward relative to the wear bushing and will engage the retrieval ring when the tool is moved upward relative to the wear bushing.

5. The downhole assembly of claim 1, further comprising a separate retrieval tool having retrieval teeth, and wherein the wear bushing includes a set of retrieval teeth for engaging the retrieval teeth of the separate retrieval tool.

6. The downhole assembly of claim 1, wherein:

each of the running-in keys include a horizontal slot; and the support ridge is sized to fit in the slot of the keys.

7. The downhole assembly of claim 1, wherein the tool further includes a plurality of circumferentially spaced apart recesses sized to accept the keys.

8. The downhole assembly of claim 7, wherein:

each of the keys includes an axially extending chamfer; and each of the recesses includes a lateral edge having a bevel for mating with the chamfer, the chamfer and bevel allowing the tool to be rotated to slide the keys out of the recesses when releasing the tool.

9. The downhole assembly of claim 1, wherein:

the tool includes a plurality of blades, and at least two of the plurality of blades include the support ridge.

10. The downhole assembly of claim 1, wherein:

the tool further includes a plurality of blades, a plurality of axially extending channels located between the blades, support ridges on at least two of the plurality of blades, and grooves on the blade above the support ridges forming retrieval teeth; and the wear bushing includes a retrieval ring having retrieval teeth for engaging the retrieval teeth of the tool, whereby the only profile that will engage the ring is that of the tool retrieval teeth.

11. The downhole assembly of claim 1, further comprising:

a casing hanger landed in the wellhead housing, the upward facing shoulder being on the casing hanger;

a seal assembly between the wellhead housing and the casing hanger landed therein; and a spring-biased anti-rotation pin on the wear bushing for engaging the seal assembly in the wellhead housing and preventing rotation of the wear bushing relative to the casing hanger.

12. The downhole assembly of claim 1, wherein:

the wear bushing includes a retrieval ring having retrieval teeth for engaging retrieval teeth of a tool; and the tool is free of any profile to engage the retrieval ring.

13. A downhole assembly for a well, comprising in combination:

a wellhead housing having an axial bore with an upward facing shoulder;

a wear bushing including a tubular member having an axial bore with an internal recess;

a plurality of radially movable running-in keys mounted in the wear bushing, the running-in keys being movably biased to protrude into the axial bore;

a retrieval ring having retrieval teeth mounted in the wear bushing, the retrieval ring being movably biased to protrude into the axial bore;

a first tool having threaded upper and lower ends for securing into a drill string;

a plurality of support ridges on the first tool, the support ridges being spaced circumferentially apart from each other to engage the keys; wherein the wear bushing is adapted to be released from the first tool by rotating the first tool relative to the wear bushing to disengage the support ridges from the keys, enabling the drill string to be lowered further into the well;

the first tool being free of any profile that mates with the retrieval ring, enabling the first tool to be pulled upward through the wear bushing without retrieving the wear bushing;

a second tool having threaded upper and lower ends for securing into a drill string in lieu of the first tool; and a plurality of grooves on the second tool forming retrieval teeth for engaging the retrieval ring, as the second tool is pulled upward through the wear bushing.

14. The downhole assembly of claim 13, wherein the first tool further comprises a plurality of axially extending channels located between the support ridges.

15. The downhole assembly of claim 13, whereby the second tool retrieval teeth will ratchet over the retrieval ring when moved downward relative to the wear bushing and will engage the retrieval ring when moved upward relative to the wear bushing.

16. The downhole assembly of claim 13, wherein:

each of the running-in keys include a horizontal slot; and the support ridge is sized to fit in the slots of the keys.

17. The downhole assembly of claim 13, wherein the first tool further includes a plurality of circumferentially spaced apart recesses sized to accept the keys.

18. The downhole assembly of claim 13, wherein the second tool is free of any profile to engage the keys.

19. A downhole assembly for a well, comprising in combination:

a wellhead housing having an axial bore with an upward facing shoulder;

a wear bushing including a tubular member having an axial bore with an internal recess;

a plurality of radially movable running-in keys mounted in the wear bushing, the running-in keys being movably biased to protrude into the axial bore;

a retrieval ring having retrieval teeth mounted in the wear bushing, the retrieval ring being movably biased to protrude into the axial bore;

a tool having threaded upper and lower ends for securing into a drill string;

a plurality of support ridges on the tool, the support ridges being spaced circumferentially apart from each other for engaging the keys, enabling the tool to support the wear bushing until the wear bushing lands on the shoulder, and wherein the wear bushing is adapted to be released from the tool by rotating the tool relative to the wear bushing to disengage the support ridges from the keys, enabling the drill string to be lowered further into the well; and a plurality of grooves on the tool forming retrieval teeth for mating with the retrieval ring as the tool is pulled upward through the wear bushing, enabling the wear bushing to be retrieved.

20. A method of implementing a wear bushing in a wellhead housing having an axial bore with an upward facing shoulder, comprising the steps of:

(a) mounting a plurality of radially movable running-in keys to the wear bushing, the running-in keys being movably biased to protrude into the axial bore;

(b) providing a tool having a plurality of support ridges, the support ridges being spaced circumferentially apart from each other;

(c) securing the wear bushing to the tool by rotating the tool and wear bushing relative to each other as necessary to align the support ridges with the keys;

(d) connecting the tool into a drill string, lowering the tool and the wear bushing into the wellhead, and landing the wear bushing on the shoulder; and then (e) rotating the tool relative to the wear bushing to disengage the support ridges from the keys, and lowering the drill string further into the well and performing drilling operations with the drill string.

21. The method of claim 20, further comprising after step (e), pulling the tool upward through the wear bushing without retrieving the wear bushing.

22. The method of claim 20, further comprising:

mounting retrieval teeth to the wear bushing;

providing the tool with retrieval teeth; and after step (e), pulling the tooth upward and engaging the retrieval teeth of the tool with the retrieval teeth of the retrieval ring and retrieving the wear bushing.

23. The method of claim 20, further comprising this step of:

mounting retrieval teeth to the wear bushing;

providing a separate retrieval tool having retrieval teeth;

after step (e), retrieving the first mentioned tool without retrieving the wear bushing;

subsequently mounting the retrieval tool into the drill string and lowering the retrieval tool through the wear bushing and performing drilling operations with the drill string; and then, retrieving the drill string and while pulling the retrieval tool upward with the drill string, engaging the retrieval teeth of the retrieval tool with the retrieval teeth of the wear bushing and retrieving the wear bushing.

* * * * *